US007484517B2

(12) United States Patent
Chen

(10) Patent No.: US 7,484,517 B2
(45) Date of Patent: Feb. 3, 2009

(54) LARGE PORTABLE UMBRELLA

(76) Inventor: Fengchun Chen, Room 303, No.5, Block 59 of Huazhong Street, South Wing, Ming Bldg. East River Residential Area, NinBo City, Zhejiang Province (CN) 315040

( * ) Notice: Subject to any disclaimer, the term of this patent is extended or adjusted under 35 U.S.C. 154(b) by 810 days.

(21) Appl. No.: 10/802,569

(22) Filed: Mar. 17, 2004

(65) Prior Publication Data

US 2004/0182429 A1 Sep. 23, 2004

(30) Foreign Application Priority Data

Mar. 21, 2003 (CN) ..... 03 1 15927

(51) Int. Cl.
*A45B 19/08* (2006.01)
*A45B 25/00* (2006.01)

(52) U.S. Cl. ..... 135/25.4; 135/20.3; 135/25.1

(58) Field of Classification Search ..... 135/15.1, 135/20.3, 25.1, 25.31, 25.4
See application file for complete search history.

(56) References Cited

U.S. PATENT DOCUMENTS 1,042,174 A * 10/1912 Tyminski ..... 135/25.31
3,156,249 A * 11/1964 Biderman ..... 135/15.1

FOREIGN PATENT DOCUMENTS

CN 95208983.1 5/1996

* cited by examiner

*Primary Examiner*—David R Dunn
*Assistant Examiner*—Danielle Jackson
(74) *Attorney, Agent, or Firm*—Merchant & Gould P.C.

(57) ABSTRACT

The invention discloses a large portable umbrella which relates to the technical field of large foldable umbrella. A large portable umbrella of the invention includes an umbrella column, supporting arms, tarpaulin, cover arms supporting tarpaulin, a develop-fold mechanism, an upper umbrella disk fixed on the top of the umbrella column, and a lower umbrella disk movable up and down along the umbrella column, wherein one end of the cover arms being hinged on the upper umbrella disk, one end of the supporting arms being hinged on the lower umbrella disk and the other end of the supporting arms being hinged at the middle of the cover arms, characterized in that a: the moving space of the lower umbrella disk is from the upper umbrella disk down to the position of the lower umbrella disk when the large umbrella is developed, and the large portable umbrella is developed when the develop-fold mechanism drives the lower umbrella disk to move downwards along the umbrella column, and the large portable umbrella is folded when the lower umbrella disk moves upwards along the umbrella column causing the space between the lower umbrella disk and the upper umbrella disk is shortened; b: each cover arm is composed of an upper cover arm and a lower cover arm, the upper cover arm and the lower cover arm being hinged with each other via a position limiting hinge which serves for limiting the developing angle of the lower cover arm. Under the circumstance where the usable umbrella cover area of the invention is equal to that of the traditional large umbrella, the length of the large portable umbrella of the invention when folded is just one half of that of traditional large umbrella, and thereby the large portable umbrella can be put into car box and is convenient for carrying, and is applicable to family junketing, flexible booth setting, floating fieldwork, etc.

8 Claims, 6 Drawing Sheets

LARGE PORTABLE UMBRELLA

FIELD OF THE INVENTION

The present invention relates to a large umbrella for shading sun and rain, in particular to a large portable umbrella which is applicable to lawn, region around swimming pool, beach, park, tea garden, fieldwork, booth setting, tourism, etc., as a portable outdoor rest tool for shading sun and rain.

DESCRIPTION OF RELATED ART

At present, the common large sunshade and umbrella used at home and abroad are larger, whose diameter is often more than 3 meters, and the length is over 1.5 meters after being folded. For instance, Chinese Patent No. 95208983.1 discloses "a large sunshade" comprising a cover, a develop-fold means, an umbrella rod, a supporting bar, and a supporting base, wherein one end of the supporting bar connecting to a supporting base and the other end of the supporting bar connecting to the umbrella rod, the umbrella rod and one end of supporting bar being hinged on the supporting base directly via pipe sleeve, the other end of the supporting bar being hinged with pipe clamp which is fixed on umbrella rod via pipe sleeve, a rope being fixed on the umbrella rod via the supporting base to form the develop-fold means. Similar to other large umbrella used at home and abroad nowadays, its lower umbrella disk or so-called supporting base portion are all move downwards when the umbrella is furled. Therefore, the length of furled umbrella is by no means less than the sum of the length of the supporting bar and the length of the upper cover arms, wherein the length of the upper cover arms means the distance from upper umbrella disk (or called upper cover etc.) to the hinge point of the supporting arms and the cover arms. Since the length of furled umbrella is longer, it is inconvenient for carrying and packing away, especially for family junketing, flexible booth setting, floating fieldwork and so on. Moreover, this kind of large umbrella is hard to put into car box, thereby limiting its practical value.

SUMMARY OF THE INVENTION

The present invention is directed to provide a large portable foldable umbrella whose length will get shorter when folded.

In order to solve the above technical problems, a large portable umbrella of the invention includes an umbrella column, supporting arms, tarpaulin, cover arms supporting tarpaulin, a develop-fold mechanism, an upper umbrella disk fixed on the top of the umbrella column, and a lower umbrella disk movable up and down along the umbrella column, wherein one end of the cover arms being hinged on the upper umbrella disk, one end of the supporting arms being hinged on the lower umbrella disk and the other end of the supporting arms being hinged at the middle of the cover arms, characterized in that a: the moving space of the lower umbrella disk is from the upper umbrella disk down to the position of the lower umbrella disk when the large umbrella is developed, and the large portable umbrella is developed when the develop-fold mechanism drives the lower umbrella disk to move downwards along the umbrella column, and the large portable umbrella is folded when the lower umbrella disk moves upwards along the umbrella column causing the space between the lower umbrella disk and the upper umbrella disk is shortened; b: each cover arm is composed of an upper cover arm and a lower cover arm, the upper cover arm and the lower cover arm being hinged with each other via a position limiting hinge which serves for limiting the developing angle of the lower cover arm.

Said umbrella column is composed of two or more sections. Each section is connected to its adjacent section via a length-dimension-shorten mechanism or an obliquity adjusting mechanism having both obliquity adjusting function and folding function. If the umbrella column is only composed of two sections, it is preferable to adopt an obliquity adjusting mechanism having both obliquity adjusting function and folding function, so as to make it have more functions. If the umbrella column is composed of more than two sections, different connecting mechanisms may be adopted to connect different sections.

Said length-dimension-shorten mechanism may be the foldable hinge structure in which the connecting ends of two adjacent sections of the umbrella column are hinged on one side and a snap-close structure is provided on the other side. Alternatively, said length-dimension-shorten mechanism may be a coaxial axial muff-coupling structure formed between two adjacent sections in which the internal and external diameter of two adjacent sections of umbrella column are matched and a position limiting lock is used. Moreover, said length-dimension-shorten mechanism may be a detachable fitting structure in which the internal and external diameter of the connecting ends of two adjacent sections of umbrella column are matched. Moreover, said length-dimension-shorten mechanism may be a screw-thread-fit structure in which the matching internal thread and screw are provided on the connecting ends of two adjacent sections of umbrella column.

Said obliquity adjusting mechanism may be designed to be of the following structure. The obliquity adjusting mechanism includes two opposite hinge blocks. The ends of the upper and the lower sections of the umbrella column are hinged on the upper and the lower ends of both hinge blocks via a pin axis respectively and clipped between the hinge blocks. A elastic lock-pin is provided in the middle of the hinge blocks. One end of the elastic lock-pin is a clip-pin, which is provided in a clip cavity on the hinge block corresponding to the clip-pin and moves transversely in the clip cavity. Two or more groups of clip-grooves matched with the clip-pin are provided at intervals on one side of the ends of the upper and the lower sections of the umbrella column corresponding to the clip-pin, and the clip-grooves are radially provided relative to the pin axis. The other end of the elastic lock-pin is provided with a button, which is provided in a button cavity on the hinge block corresponding to the button and moves transversely in the button cavity. At the middle of the elastic lock-pin is a pin for connecting the button and the clip-pin. A pressure spring compelling the clip-pin to lock into the clip-grooves all along is provided between the button and the bottom of the button cavity. In this case, the obliquity of the umbrella cover can be adjusted by pressing the button to make the clip-pin away from the clip-grooves and rotating the umbrella column to a position where another group of clip-grooves are matched with the clip-pin. However, the hinge angle of the upper and the lower sections of the umbrella column is not adjusted continuously. Said obliquity adjusting mechanism may also be designed to be of the following structure. The obliquity adjusting mechanism includes two opposite hinge blocks. The ends of the upper and the lower sections of the umbrella column are hinged on the upper and the lower ends of both hinge blocks via pin axis respectively and clipped between the hinge blocks. A worm is provided in the middle of the hinge blocks. The ends of the upper and the lower sections of the umbrella column are designed to form worm wheels which engage with the worm. Rotation of the worm can be realized by means of a sexangle or square spanner or a handgrip of stationary type. In this case, the hinge angle of the upper and the lower sections of the umbrella column is adjusted steplessly until the umbrella is folded. Said obliquity adjusting mechanism may also be designed to be of the following structure. The obliquity adjusting mechanism includes two opposite hinge blocks. The ends of the upper and the lower sections of the umbrella column are hinged on the upper and the lower ends of both hinge blocks via pin axis respectively and clipped between the hinge blocks. A screw lock, which can clamp the hinge blocks and release them, is provided in the middle of the hinge blocks. When the screw lock is screwed down, the hinge blocks clamp the umbrella column, thereby locking the umbrella column to a hinge angle. When the screw lock is released, the umbrella column can be adjusted freely to an appropriate hinge angle and even to the completely folded state, and then, the umbrella column is locked again when the screw lock is screwed down again. To make the locking state stronger, radial teeth are provided on the contact surface between the hinge blocks and the ends of the sections of the umbrella column to increase clutching force. Said two hinge blocks may be of separate type, that is, each block is an independent portion, and also may be an entire portion linked via the middle part.

Said position limiting hinge may be designed to be of the following structure. A lug having is provided on the side of the ends of the upper cover arms and the lower cover arms facing tarpaulin. The upper cover arms and the lower cover arms are hinged together through the lug by a pivot. When the lower cover arms are developed, the upper cover arms get exactly contact with end face of the lower cover arms, thereby limiting the developing angle of the lower cover arms. The position limiting hinge may also be designed to be of the following structure. The ends of the upper cover arms and the lower cover arms are designed to form semicircle. A position limiting groove board is provided on the side of the cover arms opposite to tarpaulin. The upper cover arms, the lower cover arms and the position limiting groove board are hinged together via a pin passing through the center of the semicircle ends and both sides of the position limiting groove board. The position limiting hinge may also be designed to be of the following structure. Two opposite hinge blocks are provided. Position limiting board connecting both hinge blocks is provided in the middle of the side of the hinge blocks facing tarpaulin. Position limiting block is provided on the side of the cover arms opposite to tarpaulin. Ends of the upper cover arms and the lower cover arms are hinged respectively at the ends of both hinge blocks and clipped between both hinge blocks. The position limiting hinge may also be designed to be of the following structure. A bending hinge head is provided, and on its upper end, lower end and bending portion are provided with upper, lower and middle hinge pivot points respectively, wherein the upper cover arms being hinged on the upper hinge pivot point, the lower cover arms being hinged on the middle hinge pivot point, and the supporting arms being hinged on the lower hinge pivot point. Moreover, unilateral position limiting end for limiting the developing angle of the lower cover arms is provided on the side of the hinge head opposite to tarpaulin. In a large umbrella, these position limiting hinges above mentioned may be used either separately or corporately. Furthermore, their partial structures can be replaced with each other and fit together.

Said develop-fold mechanism of the large portable umbrella includes a rope and a lever-spanner. One end of the rope is fixed on the lower umbrella disk, and the other end is fixed on the middle of the lever-spanner. One end of the lever-spanner is hinged on the umbrella column. Alternatively, the develop-fold mechanism of other type may be used. For example, the develop-fold mechanism may be designed to be of the structure in which the rope cooperates with slug, the structure in which the rope cooperates with a handgrip and a pulley, and the structure in which any prior art, such as gear engaging screw, etc., is used. However, the lever-spanner mentioned above is generally unsuitable to conventional large umbrella, since the moving distance of the lower umbrella disk is longer when the umbrella is developed, and hence the lever-spanner type is insufficient to develop the large umbrella.

A pressure spring is provided on the umbrella column between the upper umbrella disk and the lower umbrella disk in order to develop the large umbrella with ease.

A tension spring convenient for developing the lower cover arms may be provided between the lower cover arms and the upper cover arms or between the lower cover arms and the supporting arms, so that the large umbrella is developed and folded with ease.

The upper end of the upper cover arms is provided with a bending head, through which the upper cover arms are hinged on the upper umbrella disk. The arrangement of the bending head can increase the developing angle of the umbrella cover from about 130° to about 150°, so that the available cover surface of umbrella is larger and at the same time, the resistance against wind is decreased and wind-resisting ability is improved.

The umbrella column may protrude from the upper umbrella disk; a top umbrella disk is fixed on the top of the umbrella column; short cover arms supporting top tarpaulin are hinged around the top umbrella disk; top supporting arms are hinged between the short cover arms and the upper cover arms to form a linkable develop-fold four-connection mechanism, thereby making the large umbrella become a dual-layer umbrella that can be developed and folded simultaneously. The structure of the dual-layer umbrella can increase convection ventilation under umbrella, and thus make user feel cool and at the same time, enhance wind-resisting ability.

Compared with prior art, the advantages of the invention are: 1. lower umbrella disk moving upwards when a large portable umbrella of the invention is folded until it keep close to upper umbrella disk, so that supporting bar don't occupy additional space at vertical direction any more. Moreover, cooperated with foldable umbrella cover arms and foldable or detachable plural-section type umbrella column, the structure of large portable umbrella of the invention become very compact and its length is shortened by one half of that of traditional large umbrella, if its usable umbrella cover area is equal to that of traditional large umbrella, therefore it is convenient to carry; 2. It has function of adjusting angle of umbrella cover in shading sun and rain freely. Accordingly, the invention provides a large novel portable umbrella convenient for carrying and folding which improves function of shading sun and rain, thereby enhancing the practicability greatly.

DETAILED DESCRIPTION OF EMBODIMENTS

The explanation of the invention will be made in detail with reference to the accompanying drawings together with the following embodiments.

Embodiment 1

Figure 1:
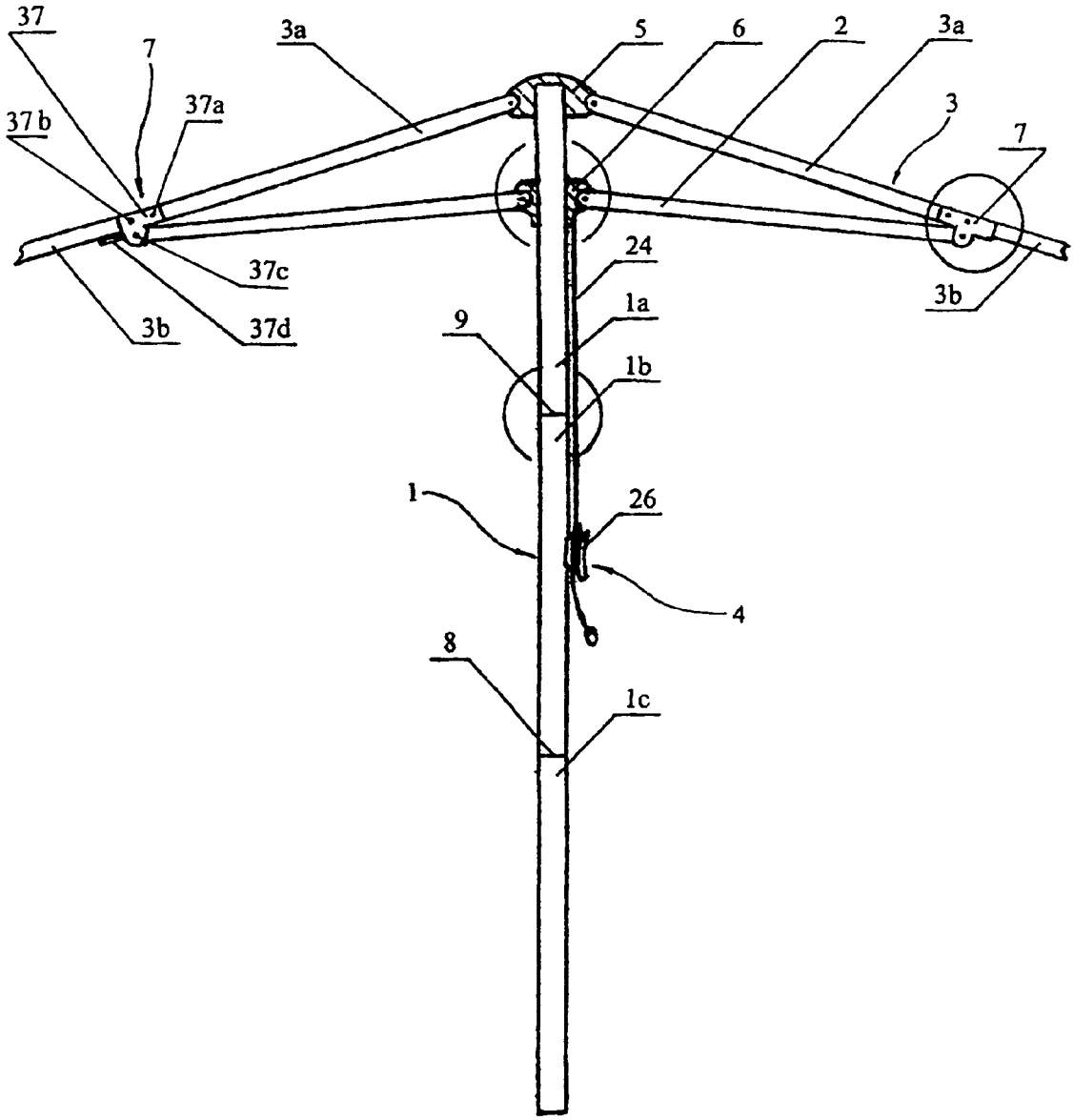
FIG. 1 is a schematic partial view showing the structure of the large portable umbrella according to one embodiment of the invention when it is developed (tarpaulin not shown), and showing the structure of the foldable umbrella cover arms formed by being hinged via position limiting hinge, the three-section umbrella column, and the develop-fold means in which a rope cooperates with a slug.
Figure 3:
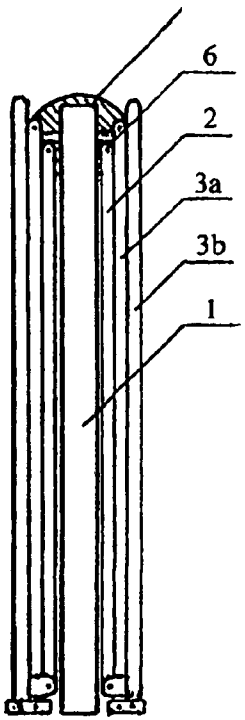
FIG. 3 is a schematic view showing the structure of the umbrella of the invention when developed completely.
Figure 2:
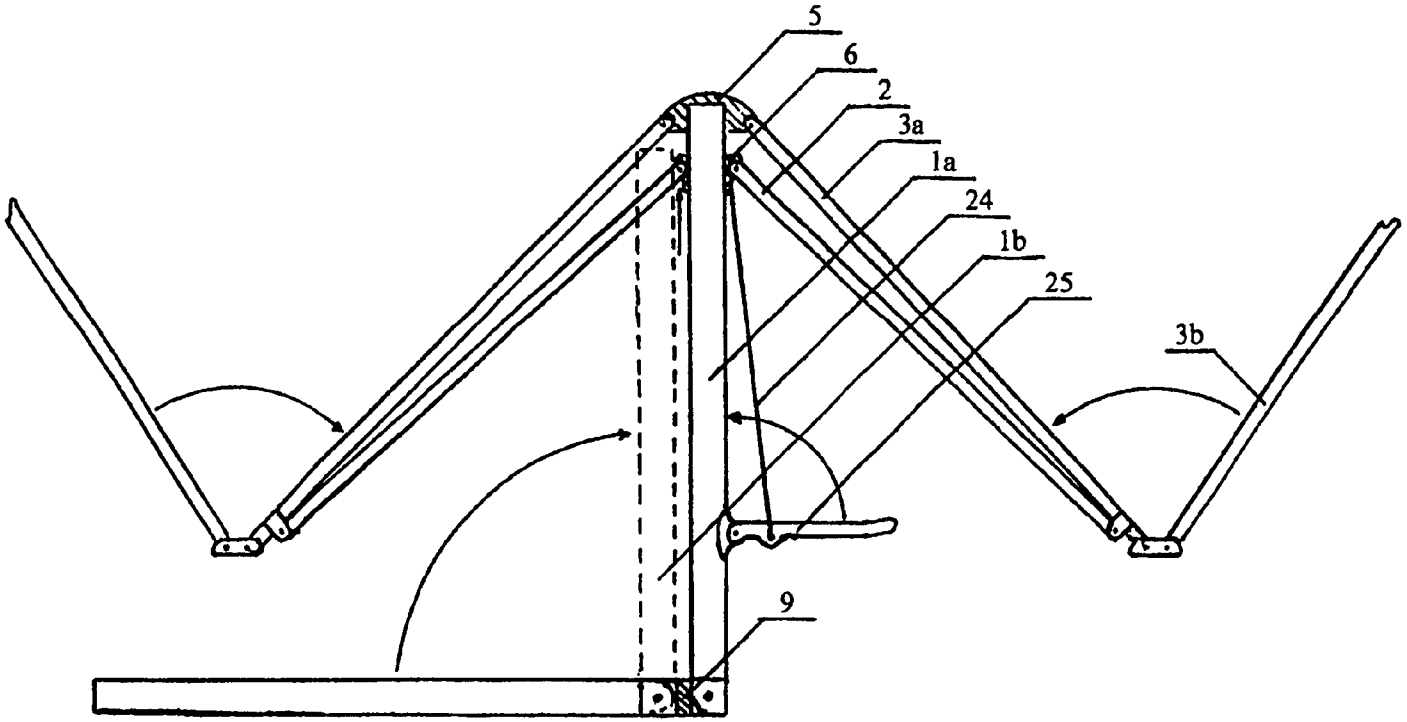
FIG. 2 is a schematic view showing the structure of umbrella of the invention in the half-folded state, and showing the structure of the foldable umbrella cover arms formed by being hinged via another position limiting hinge, the develop-fold means in which a rope cooperates with a lever-spanner, and the umbrella column hinged by hinge in the half-folded state.

FIGS. 1-15 show an embodiment of the invention, and other embodiments in which various replaceable or combinative structures of components are provided. As shown in FIGS. 1-3, a large portable umbrella of the embodiment includes an umbrella column 1, supporting arms 2, tarpaulin (not shown), cover arms 3 supporting tarpaulin, a develop-fold mechanism 4, an upper umbrella disk 5 fixed on the top of umbrella column 1, and a lower umbrella disk 6 movable up and down along umbrella column 1. Cover arms 3 are provided on and radiate from the circumference of upper umbrella disk 5 and one end of each cover arm 3 is hinged on upper umbrella disk 5. One end of supporting arms 2 is hinged on lower umbrella disk 6 and the other end of supporting arms 2 is hinged on the middle of cover arms 3. Compared with conventional large umbrellas, the large portable umbrella of the invention is of an inverse develop-fold structure, that is, the moving space of lower umbrella disk 6 is from upper umbrella disk 5 down to the position of lower umbrella disk 6 when the large portable umbrella is developed, and the large portable umbrella is developed when develop-fold mechanism 4 drives lower umbrella disk 6 to move downwards along umbrella column 1, and the large portable umbrella is folded when lower umbrella disk 6 moves upwards along umbrella column 1 causing the space between lower umbrella disk 6 and upper umbrella disk 5 is shortened. To be suitable to the inverse develop-fold structure to reduce the dimension of the large potable umbrella when folded, each of cover arms 3 is designed to be composed of an upper cover arm 3*a* and a lower cover arm 3*b*; the upper cover arm 3*a* and the lower cover arm 3*b* can be folded together. Moreover, upper cover arm 3*a* and lower cover arm 3*b* are hinged with each other via a position limiting hinge 7 which serves to limit the developing angle of lower cover arm 3*b*, thereby making cover arms 3 foldable and have enough strength to support tarpaulin.

Next, the explanation will be made in detail as to the structure of each components of the large portable umbrella of the embodiment with reference to the accompanying drawings.

As shown in FIGS. 1, 2, 9-14, umbrella column 1 may be one column or composed of two or more sections. Each section is connected to its adjacent section via a length-dimension-shorten mechanism 8 or an obliquity adjusting mechanism 9 having both obliquity adjusting function and folding function. Alternatively, obliquity adjusting mechanism 9 may be designed to only have obliquity adjusting function and cannot be foldable; in this case, obliquity adjusting mechanism 9 is used together with length-dimension-shorten mechanism 8. If umbrella column 1 is only composed of two sections, it is preferable to adopt obliquity adjusting mechanism 9 having both obliquity adjusting function and folding function, so as to make it have more functions. If umbrella column 1 is composed of more than two sections, different connecting mechanisms may be adopted to connect different sections. In the embodiment, umbrella column 1 is composed of three sections, wherein the first section 1*a* connects with the second section 1*b* via obliquity adjusting mechanism 9, and the second section 1*b* connects with the third section 1*c* via length-dimension-shorten mechanism 8. Next, the explanation will be made in detail as to the structure of length-dimension-shorten mechanism 8 and obliquity adjusting mechanism 9 with reference to the accompanying drawings.

Figure 10:
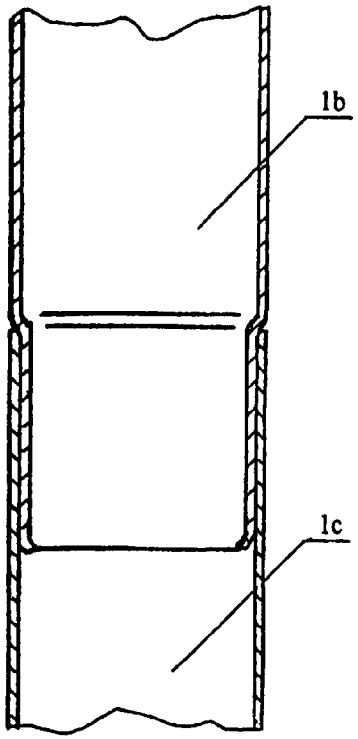
FIG. 10 is a schematic cross-sectional partial view showing the structure of the detachable umbrella column with internal and external diameter matching coupling.
Figure 9:
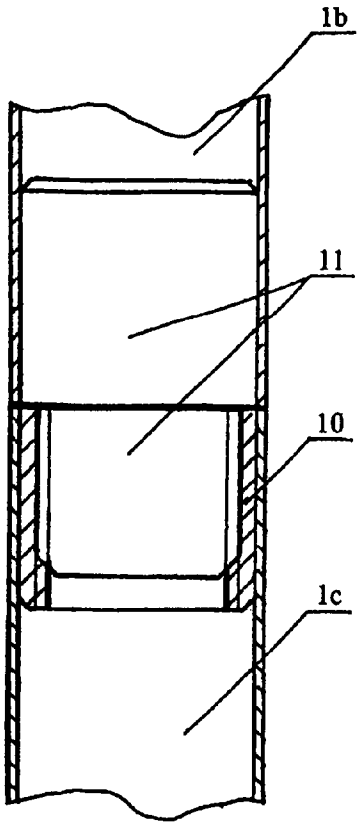
FIG. 9 is a schematic cross-sectional partial view showing the structure of the detachable umbrella column with screw-thread coupling.

Length-dimension-shorten mechanism 8 may be designed to be of a foldable hinge structure in which the connecting ends of two adjacent sections of umbrella column 1 are hinged on one side and a snap-close structure is provided on the other side. Alternatively, the length-dimension-shorten mechanism may be designed to be of a coaxial axial muff-coupling structure formed between two adjacent sections in which the internal and external diameter of two adjacent sections of umbrella column 1 are matched and a position limiting lock is used. Moreover, the length-dimension-shorten mechanism may be designed to be of a retractable umbrella column structure in which the internal and external diameter are matched. Moreover, the length-dimension-shorten mechanism may be designed to be of a screw-thread-fit structure in which the matching screw hole 10 and screw bolt 11 are provided on the connecting ends of two adjacent sections of umbrella column 1, as shown in FIG. 9. Moreover, the length-dimension-shorten mechanism may be designed to be of a detachable fitting structure in which the internal and external diameter of the connecting ends of two adjacent sections of umbrella column 1 are matched as shown in FIG. 10. In the embodiment, the detachable fitting structure, which is convenient to detach and easy to make, is applied.

FIGS. 11-14 show three examples of obliquity adjusting mechanism 9, which can not only get umbrella column 1 to be folded completely but also adjust the obliquity of the umbrella cover.

Figure 11:
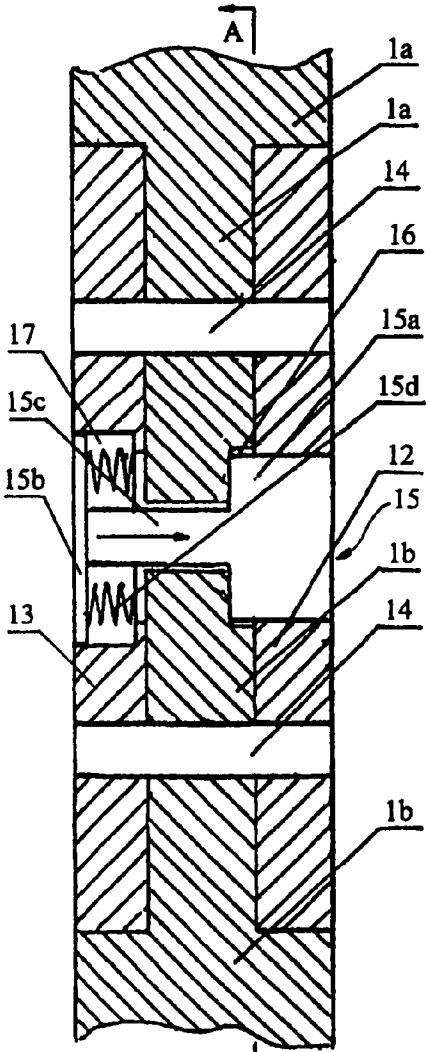
FIG. 11 is a schematic cross-sectional view showing the structure of the obliquity adjusting mechanism having a button lock.
Figure 12:
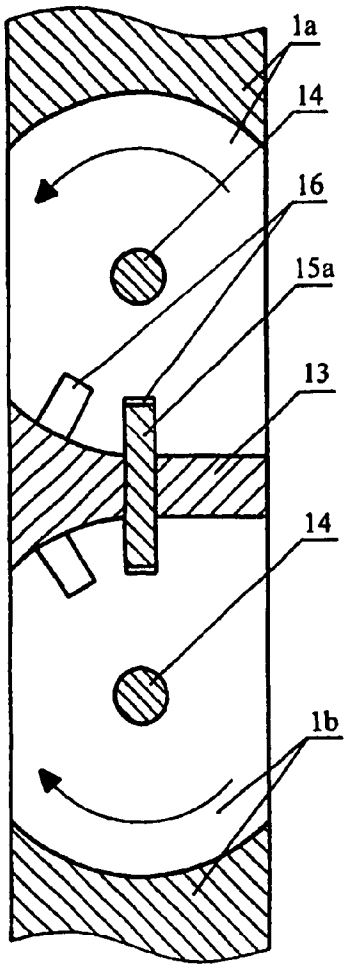
FIG. 12 is a cross-sectional view along line A-A in FIG. 11.

The structure of example 1 of obliquity adjusting mechanism 9, as shown in FIGS. 11 and 12, includes two opposite hinge blocks 12 and 13 which form a whole component connected via their middle parts. The ends of the upper and the lower sections of umbrella column 1 are hinged on the upper and the lower ends of both hinge blocks 12, 13 via pin axis 14 respectively and clipped between hinge blocks 12, 13. A elastic lock-pin 15 is provided in the middle of hinge blocks 12, 13. One end of elastic lock-pin 15 is a clip-pin 15*a*, which is provided in a clip cavity on hinge block 12 and moves transversely in the clip cavity. Two clip-grooves 16 matched with clip-pin 15*a* are provided at intervals on one side of the ends of the upper and the lower sections of umbrella column 1 corresponding to clip-pin 15*a*, and the two clip-grooves 16 are radially provided relative to pin axis 14. The other end of elastic lock-pin 15 is provided with a button 15*b*, which is provided in a button cavity 17 on hinge block 13 and moves transversely in button cavity 17. At the middle of elastic lock-pin 15 is a pin 15*c* for connecting button 15*b* and clip-pin 15*a*. A pressure spring 15*d* compelling clip-pin 15*a* to lock into clip-grooves 16 all along is provided between button 15*b* and the bottom of button cavity 17. Moreover, for the purpose of rotation, the ends of the upper and the lower sections of umbrella column 1 are designed to be in the form of circular arc, which is fit for the middle connecting part of both hinge blocks 12, 13. In this case, the obliquity of the umbrella cover can be adjusted by pressing button 15*b* to make clip-pin 15*a* away from clip-grooves 16 and rotating umbrella column 1 to a position where another clip-grooves 16 is matched with clip-pin 15*a*. However, the hinge angle of the upper and the lower sections of umbrella column 1 is not adjusted continuously.

Figure 13:
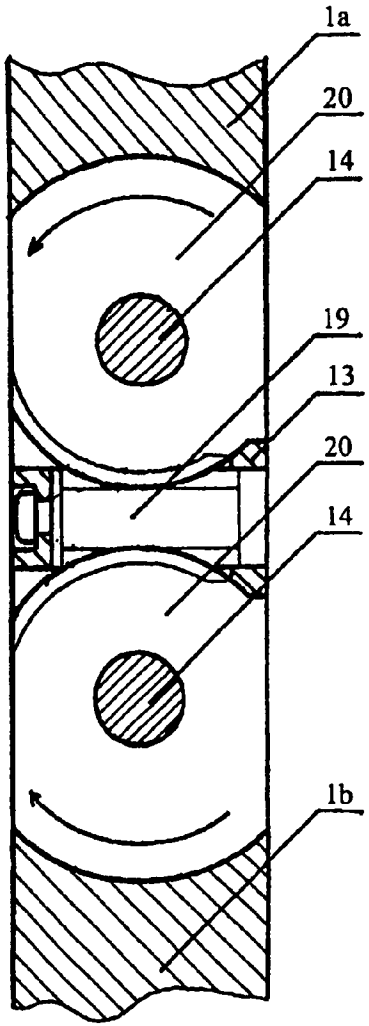
FIG. 13 is a cross-schematic sectional view showing the structure of the obliquity adjusting mechanism in which a worm engages worm wheels.

The structure of example 2 as shown in FIG. 13 includes two opposite hinge blocks 12 and 13 which form a whole component connected via their middle parts. The ends of the upper and the lower sections of umbrella column 1 are hinged on the upper and the lower ends of both hinge blocks 12, 13 via pin axis 14 respectively and clipped between the hinge blocks 12, 13. A worm 19 is provided in the middle of hinge blocks 12, 13. The ends of the upper and the lower sections of umbrella column 1 are designed to form worm wheels 20 which engage with worm 19. Rotation of worm 19 can be realized by means of a sexangle or square spanner or a handgrip of stationary type. In this case, the hinge angle of the upper and the lower sections of umbrella column 1 is adjusted steplessly until the umbrella is folded.

Figure 14:
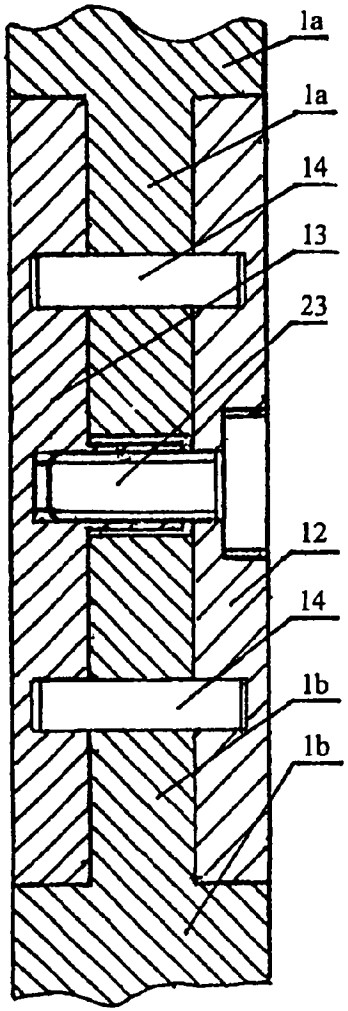
FIG. 14 is a cross-schematic sectional view showing the structure of the obliquity adjusting mechanism having a screw lock.

The structure of example 3 as shown in FIG. 14 includes two opposite hinge blocks 12 and 13 that are two independent components. The ends of the upper and the lower sections of umbrella column 1 are hinged on the upper and the lower ends of both hinge blocks 12, 13 via pin axis 14 respectively and clipped between the hinge blocks 12, 13. A screw lock 23, which can clamp both hinge blocks 12, 13 and release them, is provided in the middle of hinge blocks 12, 13. When screw lock 23 is screwed down, hinge blocks 12, 13 clamp umbrella column 1, thereby locking umbrella column 1 to a hinge angle. When screw lock 23 is released, umbrella column 1 can be adjusted freely to an appropriate hinge angle and even to the completely folded state, and then, umbrella column 1 is locked again when screw lock 23 is screwed down again. To make the locking state stronger, radial teeth are provided on the contact surface between hinge blocks 12, 13 and the ends of the sections of umbrella column 1 to increase clutching force.

Figure 7:
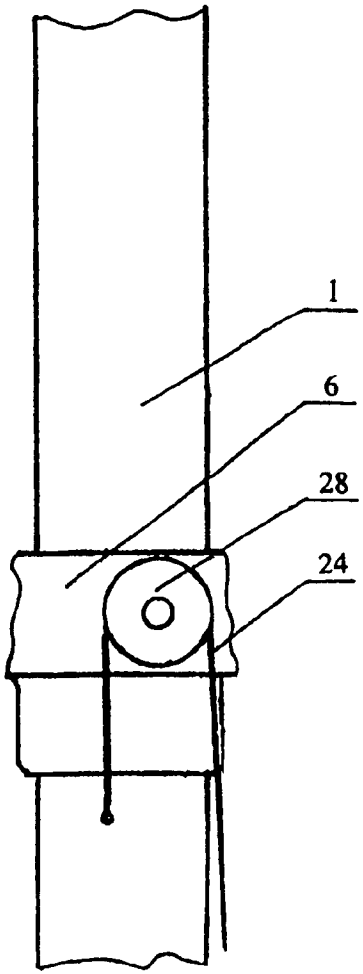
FIG. 7 is a schematic partial view showing the structure of the develop-fold mechanism provided with assembly pulley.
Figure 8:
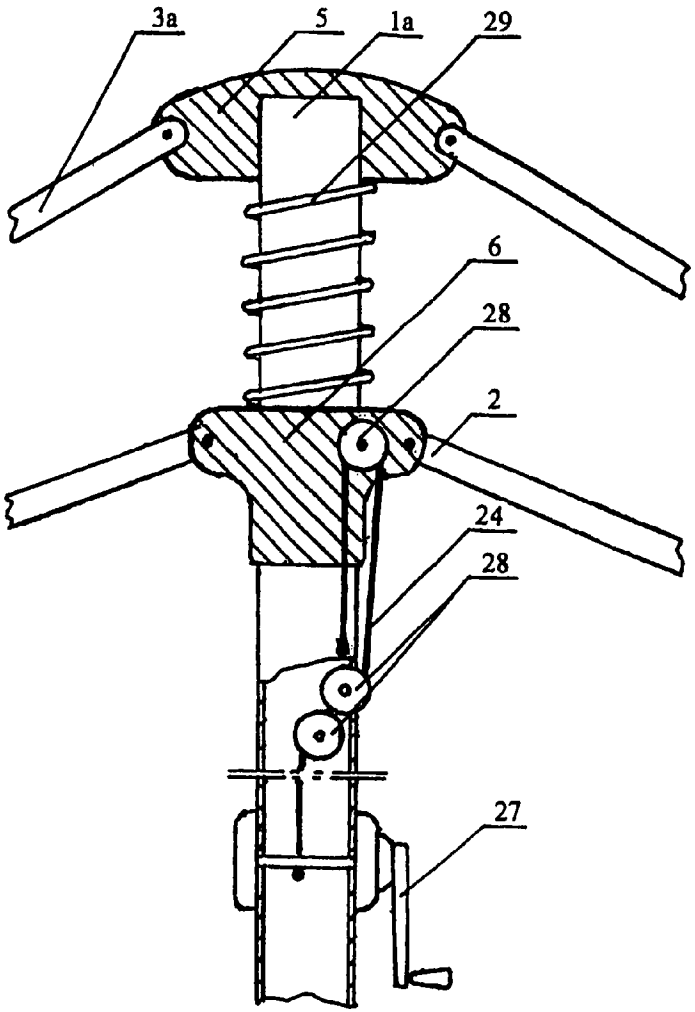
FIG. 8 is a schematic view showing the structure of the develop-fold means in which a rope cooperates with a hand-grip, and showing the structure of the umbrella column on which a pressure spring is provided between the upper and the lower umbrella disks.

The structure of develop-fold mechanism 4 of the large portable umbrella in the embodiment as shown in FIG. 2 includes a rope 24 and a lever-spanner 25. One end of rope 24 is fixed on lower umbrella disk 6, and the other end is fixed on the middle of lever-spanner 25. One end of lever-spanner 25 is hinged on umbrella column 1. Alternatively, develop-fold mechanism 4 of other type may be used. For example, develop-fold mechanism 4 may be designed to be of the structure in which rope 24 cooperates with slug 26 as shown in FIG. 1, the structure in which rope 24 cooperates with handgrip 27 and pulley 28 as shown in FIGS. 7-8, and the structure in which any prior art, such as gear engaging screw, etc., is used. However, the lever-spanner mentioned above is generally unsuitable to conventional large umbrella, since the moving distance of the lower umbrella disk is longer when the umbrella is developed, and hence the lever-spanner type is insufficient to develop the large umbrella.

A pressure spring 29 is provided on umbrella column 1 between upper umbrella disk 5 and lower umbrella disk 6, as shown in FIG. 8, in order to develop the large umbrella with ease.

Figure 15:
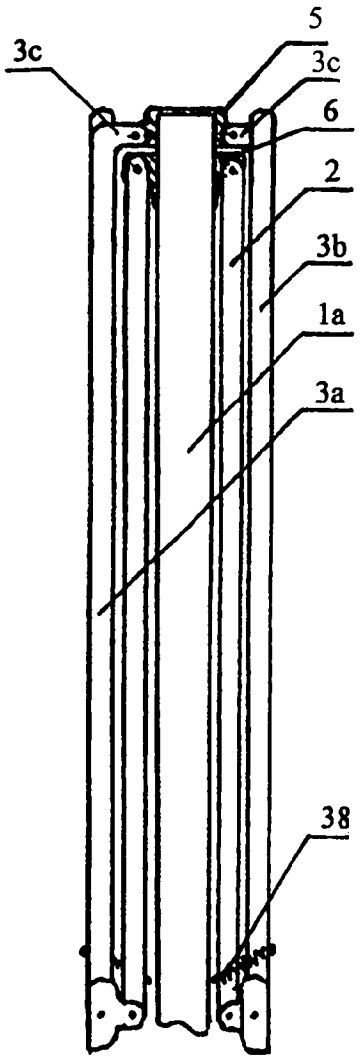
FIG. 15 is a schematic view showing the structure of a large umbrella provided with the cover arms having bending head when the umbrella is folded completely.

Upper cover arms 3*a* may be a conventional linear type structure as shown in FIG. 1 or a structure having bending head 3*c* as shown in FIG. 15. As shown in FIG. 15, the upper end of upper cover arms 3*a* is provided with a bending head 3*c*, through which upper cover arms 3*a* are hinged on upper umbrella disk 5. The arrangement of bending head 3*c* can increase the developing angle of the umbrella cover from about 130° to about 150°, so that the available cover surface of umbrella is larger and at the same time, the resistance against wind is decreased and wind-resisting ability is improved.

Figure 4:
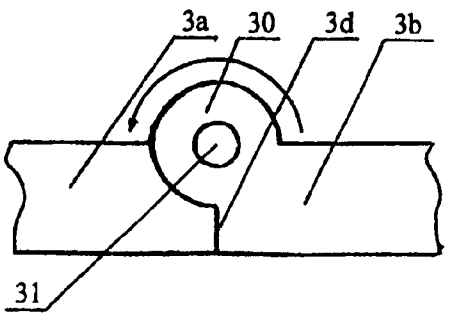
FIG. 4-6 are schematic partial views showing the structure of the foldable umbrella cover arms formed by being hinged via three different position limiting hinges, FIG. 5 showing the structure of the tension spring means which is convenient for developing and folding lower cover arms.

FIGS. 1, 4-6 show several examples of position limiting hinge 7, which are not limited to the several examples that will be described in detail as follows. The structure of example 1 of position limiting hinge 7 as shown in FIG. 4 is as follows: lug 30 having three quarter circle is provided on the side of the ends of upper cover arms 3*a* and lower cover arms 3*b* facing tarpaulin; upper cover arms 3*a* and lower cover arms 3*b* are hinged together through lug 30 by a pivot 31; when lower cover arms 3*b* are developed, upper cover arms 3*a* get exactly contact with end face 3*d* of lower cover arms 3*b*, thereby limiting the developing angle of lower cover arms 3*b*.

Figure 5:
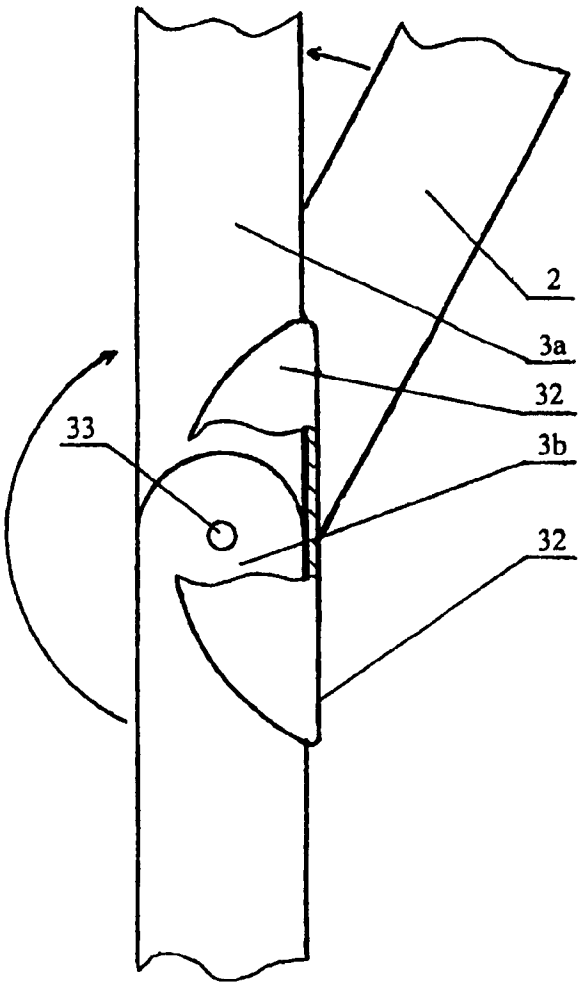

The structure of example 2 of position limiting hinge 7 as shown in FIG. 5 is as follows: the ends of upper cover arms 3*a* and lower cover arms 3*b* are designed to form semicircle; a position limiting groove board 32 is provided on the side of cover arms 3 opposite to tarpaulin; upper cover arms 3*a*, lower cover arms 3*b* and position limiting groove board 32 are hinged together via a pin 33 passing through the center of the semicircle ends and both sides of position limiting groove board 32.

Figure 6:
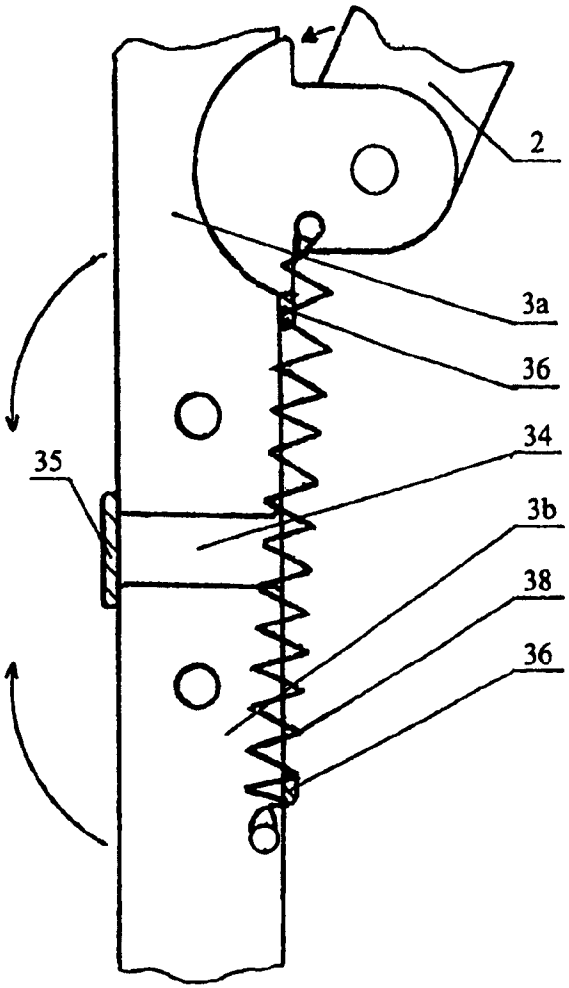

The structure of example 3 of position limiting hinge 7 as shown in FIG. 6 is as follows: two opposite hinge blocks 34 are provided; position limiting board 35 connecting both hinge blocks 34 is provided in the middle of the side of hinge blocks 34 facing tarpaulin; position limiting block 36 is provided on the side of cover arms 3 opposite to tarpaulin; ends of upper cover arms 3*a* and lower cover arms 3*b* are hinged respectively at the ends of both hinge blocks 34 and clipped between both hinge blocks 34; the developing angle of lower cover arms 3*b* is limited by position limiting board 35 and position limiting block 36 when lower cover arms 3*b* are developed.

The structure of example 4 of position limiting hinge 7 as shown in FIG. 1 is as follows: a bending hinge head 37 is provided, and on its upper end, lower end and bending portion are provided with upper, lower and middle hinge pivot points respectively, wherein upper cover arms 3*a* are hinged on upper hinge pivot point 37*a*, lower cover arms 3*b* are hinged on middle hinge pivot point 37*b*, and supporting arms 2 are hinged on lower hinge pivot point 37*c*; moreover, unilateral position limiting end 37*d* for limiting the developing angle of lower cover arms 3*b* is provided on the side of hinge head 37 opposite to tarpaulin.

In a large umbrella, these position limiting hinges above mentioned may be used either separately or corporately. Furthermore, their partial structures can be replaced with each other and fit together.

Furthermore, "the other end of supporting arms 2 is hinged on the middle of cover arms 3" as mentioned above actually means that the hinge part of supporting arms 2 and cover arms 3 is preferable on upper cover arms 3*a*.

A tension spring 38 convenient for developing lower cover arms 3*b* may be provided between lower cover arms 3*b* and upper cover arms 3*a* or between lower cover arms 3*b* and supporting arms 2, so that the large umbrella is developed and folded with ease, as shown in FIG. 6.

Embodiment 2

Figure 16:
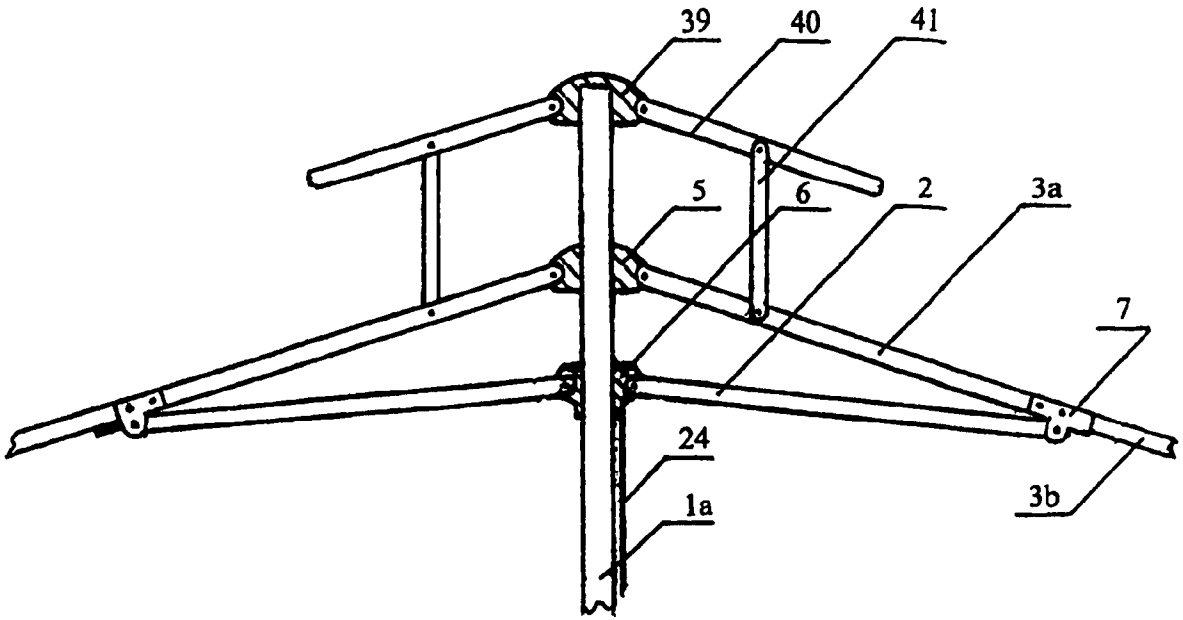
FIG. 16 is a schematic view showing the structure of a large umbrella having double-layer construction.

FIG. 16 shows another embodiment of the invention, which is substantial similar to embodiment 1 except for the following differences: umbrella column 1 of a large portable umbrella of this embodiment protrudes from upper umbrella disk 5; a top umbrella disk 39 is fixed on the top of umbrella column 1; short cover arms 40 supporting top tarpaulin are hinged around top umbrella disk 39; top supporting arms 41 are hinged between short cover arms 40 and upper cover arms 3*a* to form a linkable develop-fold four-connection mechanism; moreover, vents whose dimension is smaller than top tarpaulin are provided on main tarpaulin corresponding to top tarpaulin, thereby making the large umbrella become a dual-layer umbrella that can be developed and folded simultaneously. The structures of each component of embodiment 1 can be applied to this embodiment. The structure of the dual-layer umbrella can increase convection ventilation under umbrella, and thus make user feel cool and at the same time, enhance wind-resisting ability.

The invention claimed is:

1. A large portable umbrella includes an umbrella column (1), supporting arms (2), tarpaulin, cover arms (3) supporting tarpaulin, a develop-fold mechanism (4), an upper umbrella disk (5) fixed on the top of the umbrella column (1), and a lower umbrella disk (6) movable up and down along the umbrella column, wherein one end of the cover arms (3) being hinged on the upper umbrella disk (5), one end of the supporting arms (2) being hinged on the lower umbrella disk (6) and the other end of the supporting arms (2) being hinged at the middle of the cover arms (3), characterized in that a: the moving space of the lower umbrella disk (6) is from the upper umbrella disk (5) down to the position of the lower umbrella disk (6) when the large umbrella is developed, and the large portable umbrella is developed when the develop-fold mechanism (4) drives the lower umbrella disk (6) to move downwards along the umbrella column (1), and the large portable umbrella is folded when the lower umbrella disk (6) moves upwards along the umbrella column (1) causing the space between the lower umbrella disk (6) and the upper umbrella disk (5) is shortened; b: each of the cover arms (3) is composed of an upper cover arm (3*a*) and a lower cover arm (3*b*), the upper cover arm (3*a*) and the lower cover arm (3*b*) being hinged with each other via a position limiting hinge (7) which serves for limiting the developing angle of the lower cover arm (3*b*); said umbrella column (1) is composed of two or more sections, each section being connected to its adjacent section via a length-dimension-shorten mechanism (8) or an obliquity adjusting mechanism (9) having both obliquity adjusting function and folding function, wherein said obliquity adjusting mechanism (9) includes two opposite hinge blocks (12, 13); the ends of the upper and the lower sections of the umbrella column (1) are hinged on the upper and the lower ends of both hinge blocks (12, 13) via a pin axis (14) respectively and clipped between the hinge blocks (12, 13); a elastic lock-pin (15) is provided in the middle of the hinge blocks (12, 13); one end of the elastic lock-pin (15) is a clip-pin (15*a*), which is provided in a clip cavity on the hinge block (12) corresponding to the clip-pin (15*a*) and moves transversely in the clip cavity; two or more groups of clip-grooves (16) matched with the clip-pin (15*a*) are provided at intervals on one side of the ends of the upper and the lower sections of the umbrella column (1) corresponding to the clip-pin (15*a*), and the clip-grooves (16) are radially provided relative to the pin axis (14); the other end of the elastic lock-pin (15) is provided with a button (15*b*), which is provided in a button cavity (17) on the hinge block (13) corresponding to the button (15*b*) and moves transversely in the button cavity (17); at the middle of the elastic lock-pin (15) is a pin (15*c*) for connecting the button (15*b*) and the clip-pin (15*a*); a pressure spring (15*d*) compelling the clip-pin (15*a*) to lock into the clip-grooves (16) all along is provided between the button (15*b*) and the bottom of the button cavity (17).

2. A large portable umbrella according to claim 1 is characterized in that: said length-dimension-shorten mechanism (8) is the foldable hinge structure in which the connecting ends of two adjacent sections of the umbrella column (1) are hinged on one side and a snap-close structure is provided on the other side; or said length-dimension-shorten mechanism (8) is a coaxial axial muff-coupling structure formed between two adjacent sections in which the internal and external diameter of two adjacent sections of the umbrella column (1) are matched and a position limiting lock is used; or said length-dimension-shorten mechanism (8) is a detachable fitting structure in which the internal and external diameter of the connecting ends of two adjacent sections of umbrella column (1) are matched; or said length-dimension-shorten mechanism (8) is a screw-thread-fit structure in which the matching screw hole (10) and screw bolt (11) are provided on the connecting ends of two adjacent sections of umbrella column (1), wherein the screw hole (10) having internal thread.

3. A large portable umbrella according to claim 1 is characterized in that: said position limiting hinge (7) is of the following structure: a lug (30) having is provided on the side of the ends of the upper cover arms (3*a*) and the lower cover arms (3*b*) facing tarpaulin; the upper cover arms (3*a*) and the lower cover arms (3*b*) are hinged together through the lug (30) by a pivot (31); when the lower cover arms (3*b*) are developed, the upper cover arms (3*a*) get exactly contact with end face of the lower cover arms (3*b*), thereby limiting the developing angle of the lower cover arms (3*b*); or said position limiting hinge (7) is of the following structure: the ends of the upper cover arms (3*a*) and the lower cover arms (3*b*) are designed to form semicircle; a position limiting groove board (32) is provided on the side of the cover arms (3) opposite to tarpaulin; the upper cover arms (3*a*), the lower cover arms (3*b*) and the position limiting groove board (32) are hinged together via a pin (33) passing through the center of the semicircle ends and both sides of the position limiting groove board (32); or said position limiting hinge (7) is of the following structure: two opposite hinge blocks (34) are provided; position limiting board (35) connecting both hinge blocks (34) is provided in the middle of the side of the hinge blocks (34) facing tarpaulin; position limiting block (36) is provided on the side of the cover arms opposite to tarpaulin; ends of the upper cover arms (3*a*) and the lower cover arms (3*b*) are hinged respectively at the ends of both hinge blocks (34) and clipped between both hinge blocks (34); or said position limiting hinge (7) is of the following structure: a bending hinge head (37) is provided, and on its upper end, lower end and bending portion are provided with upper, lower and middle hinge pivot points respectively, wherein the upper cover arms (3*a*) being hinged on the upper hinge pivot point (37*a*), the lower cover arms (3*b*) being hinged on the middle hinge pivot point (37*b*), and the supporting arms (2) being hinged on the lower hinge pivot point (37*c*); moreover, unilateral position limiting end (37*d*) for limiting the developing angle of the lower cover arms (3*b*) is provided on the side of the hinge head (37) opposite to tarpaulin.

4. A large portable umbrella according to claim 1 is characterized in that: said develop-fold mechanism (4) of the large portable umbrella includes a rope (24) and a lever-spanner (25); one end of the rope (24) is fixed on the lower umbrella disk (6), and the other end is fixed on the middle of the lever-spanner (25); one end of the lever-spanner (25) is hinged on the umbrella column (1).

5. A large portable umbrella according to claim 1 is characterized in that: a pressure spring (29) is provided on the umbrella column (1) between the upper umbrella disk (5) and the lower umbrella disk (6).

6. A large portable umbrella according to claim 1 is characterized in that: a tension spring (38) convenient for developing the lower cover arms (3*b*) is provided between the lower cover arms (3*b*) and the upper cover arms (3*a*) or between the lower cover arms (3*b*) and the supporting arms (2).

7. A large portable umbrella according to claim 1 is characterized in that: the upper end of the upper cover arms (3*a*) is provided with a bending head (3*c*), through which the upper cover arms (3*a*) are hinged on the upper umbrella disk (5).

8. A large portable umbrella according to claim 1 is characterized in that: the umbrella column (1) protrudes from the upper umbrella disk (5); a top umbrella disk (39) is fixed on the top of the umbrella column (1); short cover arms (40) supporting top tarpaulin are hinged around the top umbrella disk (39); top supporting arms (41) are hinged between the short cover arms (40) and the upper cover arms (3*a*) to form a linkable develop-fold four-connection mechanism, thereby making the large umbrella become a dual-layer umbrella that can be developed and folded simultaneously.

* * * * *